United States Patent [19]

Puschner et al.

[11] Patent Number: 4,825,651

[45] Date of Patent: May 2, 1989

[54] DEVICE AND PROCESS FOR SEPARATING SOOT OR OTHER IMPURITIES FROM THE EXHAUST GASES OF AN INTERNAL-COMBUSTION ENGINE

[75] Inventors: Herbert A. Puschner, Schwanenwede, Fed. Rep. of Germany; Johann Fürtauer, Neuhofen, Austria

[73] Assignee: Bayerische Motoren Werke Aktiengesellschaft, Munich, Fed. Rep. of Germany

[21] Appl. No.: 929,193

[22] PCT Filed: Feb. 7, 1986

[86] PCT No.: PCT/EP86/00066

§ 371 Date: Dec. 4, 1986

§ 102(e) Date: Dec. 4, 1986

[87] PCT Pub. No.: WO86/04640

PCT Pub. Date: Aug. 14, 1986

[30] Foreign Application Priority Data

Feb. 12, 1985 [DE] Fed. Rep. of Germany ..... 3504737

[51] Int. Cl.[4] ..... F01N 3/02; H05B 6/64

[52] U.S. Cl. ..... 60/275; 55/96; 55/268; 55/466; 55/DIG. 30; 60/295; 60/303; 110/250; 110/346; 219/10.55 A

[58] Field of Search ..... 60/274, 275, 295, 303; 55/96, 268, 269, 466, DIG. 30; 219/10.55 R, 10.55 A; 431/5; 110/250, 346

[56] References Cited

U.S. PATENT DOCUMENTS

| | | | |
|---|---|---|---|
| 3,461,261 | 8/1969 | Lewis et al. . | |
| 3,465,114 | 9/1969 | Bleackley et al. . | |
| 3,620,008 | 11/1971 | Newbold | 60/275 |
| 4,207,452 | 6/1980 | Arai . | |
| 4,417,116 | 11/1983 | Black . | |
| 4,477,771 | 10/1984 | Nagy | 324/58.5 C |
| 4,506,506 | 3/1985 | Usui | 60/303 |
| 4,718,358 | 1/1988 | Nomi | 110/250 |

FOREIGN PATENT DOCUMENTS

| | | | |
|---|---|---|---|
| 3024539 | 4/1982 | Fed. Rep. of Germany . | |
| 57-26317 | 2/1982 | Japan . | |
| 58114 | 4/1984 | Japan | 60/303 |
| 11416 | 1/1986 | Japan | 60/275 |
| 2080140 | 2/1982 | United Kingdom | 55/DIG. 30 |

*Primary Examiner*—Douglas Hart
*Attorney, Agent, or Firm*—Barnes & Thornburg

[57] ABSTRACT

A device and method for separating soot or other impurities from the exhaust gases of an internal-combustion engine, particularly a diesel internal-combustion engine, comprises a microwave source that is coupled to the intermediate section of the exhaust pipe that is constructed for the development of an electromagnetic field, an effective burning of the soot with a low flow resistance, the intermediate section being developed as a cavity resonator and at its exhaust gas inlet and exhaust gas outlet, is equipped with a metal grid, and an insert made of a dielectric material in the cavity resonator concentrates the exhaust gas flow in the area of high energy density of the electromagnetic field.

18 Claims, 4 Drawing Sheets

DEVICE AND PROCESS FOR SEPARATING SOOT OR OTHER IMPURITIES FROM THE EXHAUST GASES OF AN INTERNAL-COMBUSTION ENGINE

This invention relates to a device and a process for separating soot or other impurities from the exhaust gases of an internal-combustion engine, particularly of a Diesel internal-combustion engine, the device having a microwave source, that is coupled to an intermediate section of the exhaust pipe and excites an electromagnetic field there.

From DE-PS No. 30 24 539, a device of this type is known where the intermediate section contains an exhaust gas filter that is held by a metal body and through which the exhaust gases flow essentially radially. The exhaust gas filter has the purpose of holding back the soot in the exhaust gases. If the soot deposits exceed an indicated degree, an electromagnetic field is excited in the intermediate section by means of which the soot is to be burned.

It is a disadvantage in the case of the arrangement known from DE-PS No. 30 24 539 that the exhaust gas filter in an increasing depositing of soot, represents a considerable flow resistance to the exhaust gases that, particularly in the case of internal-combustion engines, results in losses of performance. Since the filter is held by a metal die that projects coaxially into the adapter, the electromagnetic field develops essentially between the front wall of the metal die and the front wall and the adapter. However, only very few lines of electric flux end on the circumference of the metal die on a which filter mat is disposed. The energy density of the electromagnetic field is therefore negligibly low in the vicinity of the filter mat. The intended burning of the soot particles deposited there, for this reason, cannot be carried out. In the area of high energy density, on the other hand, namely at the front wall of the die, no filter mat is located.

In contrast, it is the objective of the invention to further develop the device of the initially mentioned type in such a way that an effective burning of the soot is carried out at a low flow resistance.

According to the invention, this objective is achieved by the fact that the adapter is developed as a cavity resonator and in its exhaust gas inlet and exhaust gas outlet has one metal grid respectively, and that in the cavity resonator, an insert made of a dielectric material concentrates the exhaust gas flow in an area of high energy density of the electromagnetic field.

The advantages of the invention are that the exhaust gases flow through the cavity resonator over its whole axial length in the area of high microwave energy density at and during their dwell time in the resonator are burned by the microwave energy. In this case, the two metal grids, also in the area of the exhaust gas inlet and the exhaust gas outlet, produce a sufficiently metallic limiting of the microwave field by means of which the high quality of the resonator is achieved that is required for attaining high energy densities and a homogenous field, and the unavoidable radiation of microwave energy through the exhaust pipe is effectively reduced. Since, in addition, the exhaust gas flow by the dielectric insert during the passage through the radiator is concentrated in the area of high energy density, the microwave field can in this area effectively burn the soot particles passing through at a high speed.

By means of the invention, a device is therefore obtained that is simple in its structure and by means of which installations into the resonator are avoided that form flow resistances and in addition the servicing work is eliminated that is required for a soot retaining device. The required microwave source may also, since radiation losses from the resonator are largely avoided, be designed to be relatively small.

Preferably, the device, during the operating time of the internal-combustion engine, is switched on continuously or at predetermined intervals in order to continuously burn the soot particles flowing into the resonator.

In accordance with the invention metal grids at the exhaust gas inlet and outlet are developed as honeycomb grids with a small wall thickness and extend particularly from the exhaust gas inlet and outlet for an indicated axial minimum length into the exhaust pipe. In the case of this development of the metal grids, the flow resistance in the exhaust pipe that results in undesirable performance losses of the internal-combustion engine is increased only insignificantly while a sufficiently closed metallic surface is offered to the electromagnetic field inside the resonator that effectively prevents the radiating of microwaves.

According to a preferred embodiment of the invention, the exhaust gas inlet and the exhaust gas outlet are arranged opposite one another at both front walls of the resonator and have essentially the same nominal width as the exhaust pipe. The two front walls are connected by a circumferential wall, preferably having a circular section, the nominal width of which is determined by the natural frequency by means of which the resonator and the microwave source are operated. Because of the operating frequency permitted by postal regulations, the nominal width of the resonator is larger than that of the exhaust pipe.

The resonator is developed as a cylindrical $E_{010}$-resonator and operated with oscillation mode $E_{010}$, and the exhaust pipe is preferably flange-mounted centrally on the front side so that the axis of the exhaust pipe and the axis of rotation of the resonator are in alignment. The lines of electric flux and the corresponding induced currents have their maximum in the center of the resonator and continuously diminish toward the outside, a high energy density existing in the central area. In the case of this embodiment of the invention, the dielectric insert is developed as a pipe with the nominal width of the exhaust pipe and extends, in alignment with the exhaust gas pipe, from the inlet to-the outlet of the resonator. In the case of this embodiment, the insert leads the exhaust gas flow homogeneously through the resonator and prevents the exhaust gases from coming in contact with the metallic walls of the resonator, counteracting an undesirable heating of the resonator that leads to a change of the natural frequency. For this purpose, the insert is selected in such a way that it affects the electromagnetic field as little as possible. It should therefore consist of a material of a dielectric constant with a low loss factor that, in addition, results in a thermal insulation that is as good as possible. Glass or a lossfree ceramic material for this reason are especially suitable.

As an alternative, the resonator may be designed and operated as an $H_{010}$-resonator or an $E_{010}$-Resonator, in which case naturally a design and an operation is also possible in still other suitable oscillation modes.

If the resonator is designed and operated as an $H_{011}$- or $E_{020}$-resonator, the area of high energy density coincides with a ring zone around the axis of rotation of the resonator. Preferably, a ceramic body in the shape of a hollow or massive cylinder is then inserted centrally and axially into the resonator that guides the exhaust gas flow into the exterior area of the resonator. In the case of this embodiment, a second pipe-shaped ceramic body is inserted concentrically with respect to the first ceramic body that forms the outer edge of the ring zone and in this case still extends at a distance from the outer wall of the resonator so that the exhaust gases do not come in contact with the resonator wall. The inner ceramic body, at its ends, tapers preferably conically and with the end cones, projects into slightly conical connecting sections of the exhaust pipe that also again, for example, in the area of the nominal width, contains the honeycomb metal grids.

In a generalized way, all $E_{01n}$-resonators or $H_{01m}$-resonators, n=0, 1, 2, 3 . . . or m=1, 2, 3 . . . , are basically suitable that are operated correspondingly. The index n and m in this case is a measurement of the relative axial length L of the resonator, measured in whole multiples of half the resonance wave length $\lambda_{0/2}$. Larger overall lengths, i.e. oscillation modes/resonators with a resonators with a higher n or m index, may be advantageous especially if, for a sufficient burning, particles must be extended.

If it should prove to be necessary—for example, because of a very high exhaust gas velocity or a performance emission of the microwave source that is too low—to increase the dwell time in the burning zone, preferably several resonators in series may also be inserted into the exhaust pipe. Adjacent resonators may then be arranged so that they border on one another and between them have a joint front wall with an exhaust gas opening that carries one metal grid respectively. This arrangement requires only one coupling of the microwave source that takes place preferably via wave guides and a coupling hole, if coupling elements, such as coupling holes or coupling loops, are worked into the joint front walls of the resonators.

If, on the other hand, it should be necessary to further decrease the low flow resistance cause by the metal grids and the resonator in order to achieve a better engine performance, according to the invention, several resonators may also be inserted into the exhaust gas pipe in parallel to one another.

So that the resonator and/or the microwave source, if possible, during the operation, must not be tuned off in frequency, the resonator as well as the microwave source are thermally decoupled as effectively as possible preferably from the exhaust pipe. In, addition, it may be necessary to cool the resonators by means of a cooling system. The cooling-water system of the internal-combustion engine is especially advantageously suitable for cooling the cavity resonator or resonators. For this purpose, the cavity resonator may be equipped with a cooling jacket and the space between the resonator wall and the cooling jacket may be continuously admitted with coolant. In addition, the resonator advantageously is made of a metal with a low coefficient of thermal expansion.

In the case of the process according to the invention, the exhaust gases of an internal-combustion engine, particularly of a diesel internal-combustion engine, are continuously or during predetermined operating intervals, guided through an electromagnetic microwave field of high energy density by means of which the combustible components contained in the exhaust gases are effectively burned without increasing the flow resistance for the exhaust gases.

This and other objects, features and advantages of the present invention will become more apparent from the following descriptions when taken in connection with the accompanying drawings which show, for the purposes of illustration only, embodiments in accordance with the present invention.

BRIEF DESCRIPTION OF THE DRAWINGS

Referring now to the drawings wherein like reference numerals are used to designate like parts, FIGS. 1 and 2 show a first embodiment of the device in longitudinal and cross-section. A microwave cavity resonator 1 is inserted as an intermediate section into an exhaust pipe 15 of a diesel internal-combustion engine that is not shown. The cavity resonator 1 has a first front wall 2, at an indicated axial distance here a second front wall 3 and a circular-cylindrical circumferential wall 4 which connects the outer circumference of the front walls 2 and 3 with one another. The front walls 2 and 3 concentrically to the axis of rotation have an exhaust gas inlet 6 and an exhaust gas outlet 8 having approximately the nominal width of the exhaust pipe 15. The exhaust pipe 15, at the inlet 6 and at the outlet 8, either in one piece or via a flange connection, changes over into the front walls 2, 3 or a corresponding inlet or outlet connection piece. The resonator consists of a metal with a low coefficient of thermal expansion, such as special steel, and may possibly at its inner surface be coated by an electrically highly conductive layer.

Figure 2:
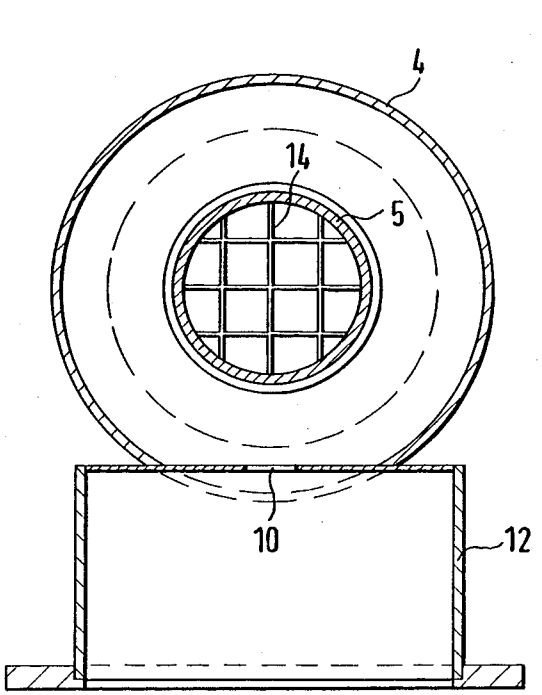
FIG. 2 is a cross-section through the device according to FIG. 1 along Line II—II.

Via a wave guide 12 that ends at the circumferential wall 4 of the resonator 1 and contains a coupling hole 10 leading into the interior space of the cavity resonator, microwave energy from a microwave source 18 of a suitable construction is fed into the resonator 1 at such a frequency that in the resonator, the electromagnetic field is developed with a desired oscillation mode, such as an $E_{010}$-, resonance, that with increasing distance from the axis of rotation has a decreasing electrical field and decreasing electrical energy density.

The exhaust gas inlet 6 and the exhaust gas outlet 8 are provided with a honeycomb-shaped metal grid 14 respectively which is formed of a thin metal sheet and with an indicated minimum length projects into the exhaust pipe 15 in order to produce for the electromagnetic field a sufficient metallic limit of the resonator volume and be able to also guide the exhaust gases without any significant flow resistance through the resonator.

In the resonator 1, a pipe-shaped dielectric insert 5 is mounted—from one front wall to the other—, the nominal width of which is equal to the exhaust pipe 15. The insert 5 is arranged centrally and axially between the exhaust gas inlet and the exhaust gas outlet 8 in alignment with the exhaust pipe 15 and guides the exhaust gases without any change of the crosssection through the resonator area with a high energy density. Since the nominal width or the diameter of the resonator 1 is much greater than the nominal width of the exhaust pipe 15 and is determined by the natural frequency at which the device—according to postal regulations—may be operated, the exhaust gas flow, by means of the insert 5, is guided at a larger distance from the resonator wall which, as a result, remains relatively cold and experiences little or no thermal expansion.

Figure 1:
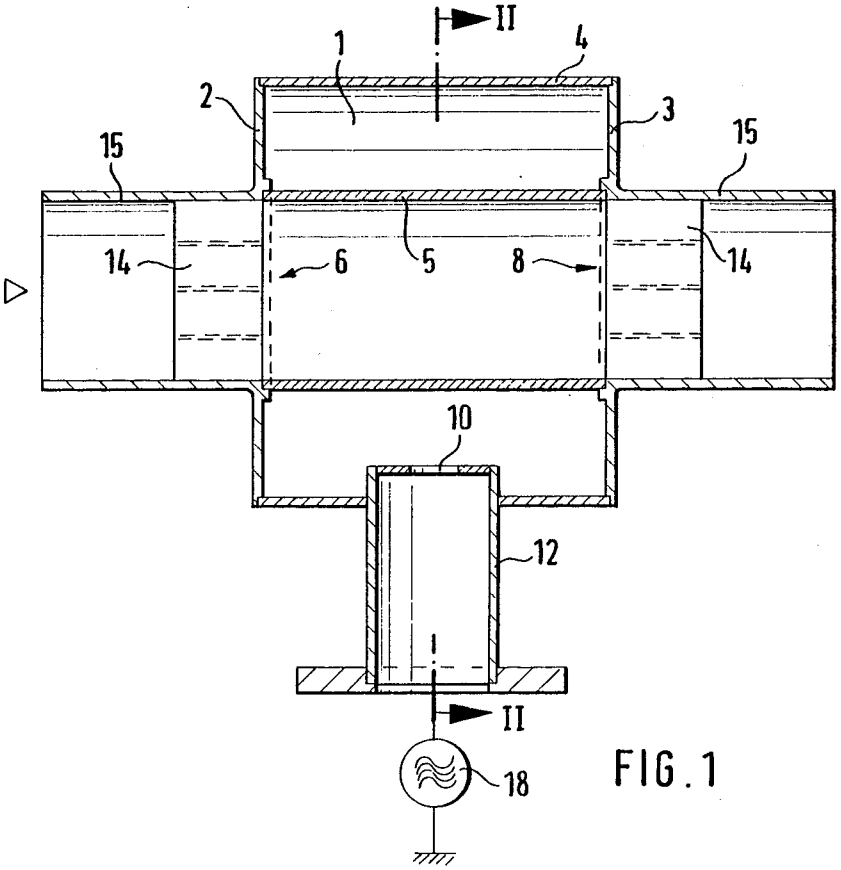
FIG. 1 is a longitudinal section through a device according to the invention.
Figure 3:
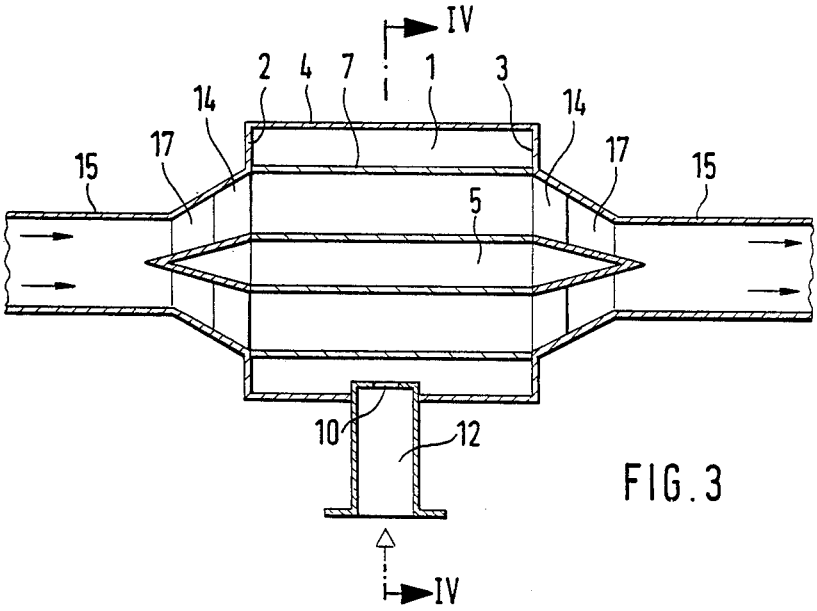
FIG. 3 is a longitudinal section through a second embodiment of the device.
Figure 4:
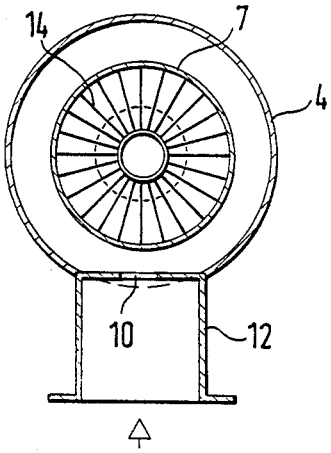
FIG. 4 is a cross-section along line A-B of FIG. 3.

FIGS. 3 and 4 show a construction corresponding to FIG. 1 where inserted into the exhaust pipe 15 is an $H_{010}$-resonator having distance front walls 2, 3 and the circumferential wall 4 that is located in-between as well as the exhaust gas inlet 6 and outlet 8 that, by means of a wave guide 12 and the coupling hole 10, receives microwave energy for the exciting of the $H_{010}$-oscillation. In the case of this oscillation mode, the area of high energy density has the shape of a ring zone. In order to therefore guide the exhaust gases during the passage through the resonator 1 in this ring zone, a cylinder-shaped dielectric insert 5 that tapers conically at its ends, is axially and centrally inserted into the resonator 1, in which case the end cones of the insert 5, through the inlet 6 and the outlet 8, project into the exhaust pipe 15 that has correspondingly conical sections 17.

The honeycomb-shaped metal grid 14, in the shown embodiment, is mounted concentrically around the end cones of the insert 5 in the area of the inlet 6 and of the outlet 8. In order to limit the ring zone also toward the outside, a second dielectric insert 7 in the shape of a pipe is concentrically with respect to the first insert 5 inserted into the resonator that limits the ring zone toward the outside and at the same time protects the resonator wall from excessive heating.

Figure 5:
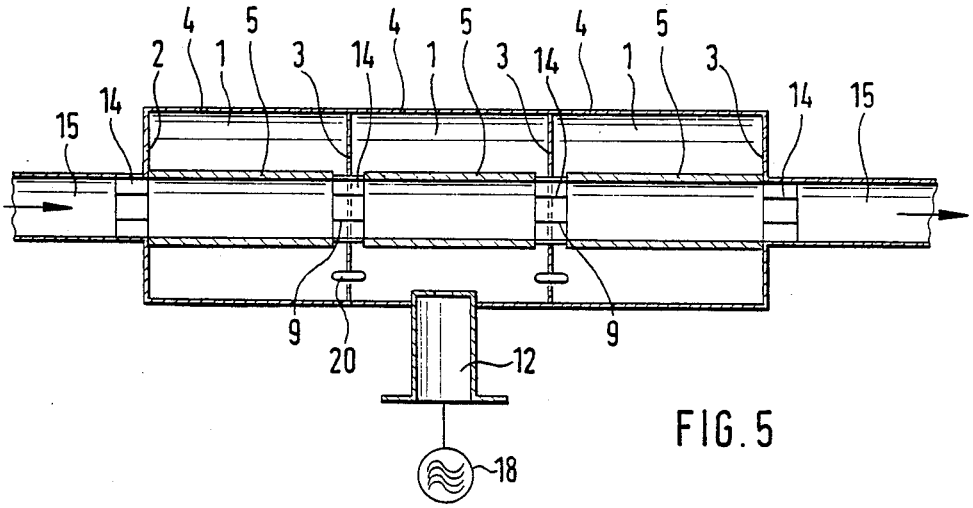
FIG. 5 is a longitudinal section through a third embodiment of the device.

In FIG. 5, seveeral $E_{010}$-resonators that are all constructed corresponding to FIG. 1 are inserted in series into an exhaust pipe 15. Adjacent resonators 1 are arranged so that they border on one another and have a joint front wall 3 that, like the outer front walls 2, 3, have a central exhaust gas opening 9 that has the nominal width of the exhaust pipe 15 and carries one honeycomb-shaped metal grid 14 respectively for the electromagnetic delimiting of the interior of the resonator. Between the inlet 6 of the first resonator 1, the exhaust gas openings 9 and the outlet 8 of the last resonator 1, pipe-shaped dielectric inserts 5 having the nominal width of the exhaust pipe 15 are inserted that guide the exhaust gas flow centrally. One of the resonators 1, via a wave guide 12, is connected with the microwave source 18. The joint front walls 3 each also have a coupling element 20, such as a coupling loop or a coupling opening, in order to also feed the resonators that follow with microwave energy.

Although the present invention has been described and illustrated in detail, it is to be clearly understood that the same is by way of illustration and example only, and is not to be taken by way of limitation. The spirit and scope of the present invention are to be limited only by the terms of the appended claims.

Figure 6:
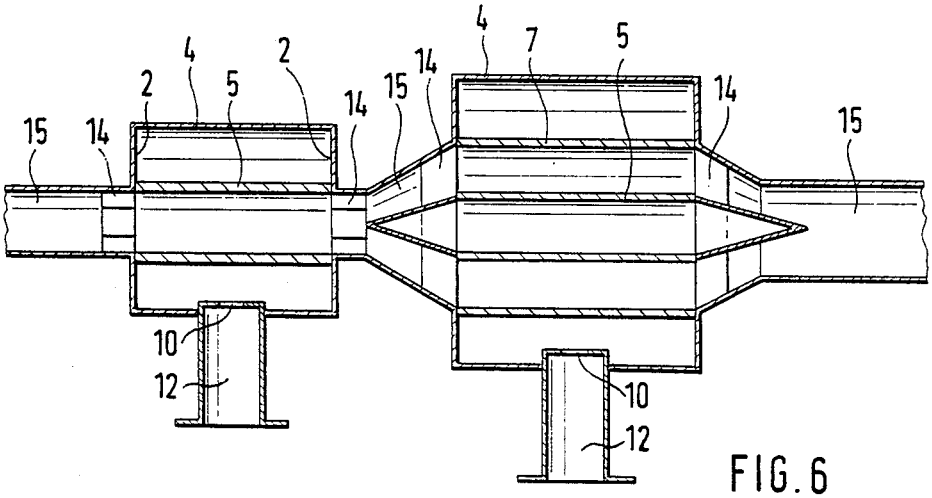
FIG. 6 is a longitudinal section through a fourth embodiment of the device.

According to FIG. 6, an $E_{010}$-resonator corresponding to FIG. 1 and an $H_{011}$-resonator corresponding to FIG. 3 are inserted in series into the exhaust pipe 15. Both resonators, via one separate wave guide 12 respectively, are fed by the microwave source 18.

Figure 7:
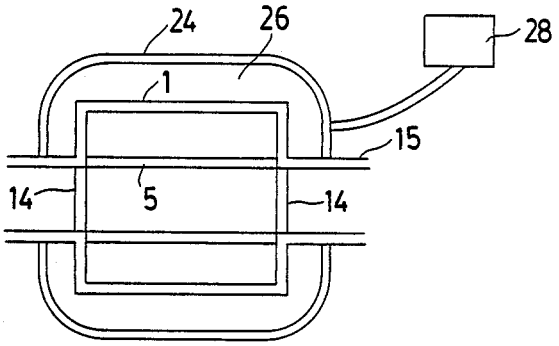
FIG. 7 is a schematic view of a cooling system for cooling the resonators according to certain preferred embodiments of the invention.
Figure 8:
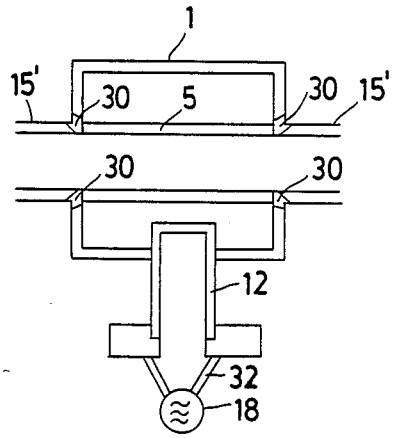
FIG. 8 is a schematic view of the thermally decoupled attachments of the resonator and the microwave source according to certain preferred embodiments of the invention.

The individual resonator or the several resonators that are connected in series or in parallel, for achieving a constancy of frequency that is as high as possible, can be thermally decoupled from the exhaust pipe 15, as shown schematically at 30 in FIG. 8. Also, the individual resonator 1 can be thermally decoupled from the microwave source 18, as shown schematically at 32 in FIG. 8. In addition, the resonators can be cooled by means of cooling systems that may be integrated, for example, into the cooling systems of the internal-combustion engines. As shown schematically in FIG. 7, the resonator 1 is equipped with a cooling jacket 24. A space 26 between the cooling jacket 24 and the resonator wall can be continuously admitted with coolant. The cooling jacket 24 and space 26 are connected to the coolant system 28 of the internal-combustion engine.

We claim:

1. A device for eliminating soot or other impurities from an exhaust gas flow of an internal-combustion engine, comprising:

an exhaust pipe including an intermediate section being formed as a cavity resonator having an exhaust gas inlet and an exhaust gas outlet and a respective outer section extending from each of the intermediate section exhaust gas inlet and exhaust gas outlet;

a microwave source coupled to said intermediate section;

a metal grid disposed in said exhaust gas inlet and a metal grid disposed in said exhaust gas outlet; and insert means made of a dielectric material for concentrating the exhaust gas flow in an area of high energy density of the electromagnetic field thereby at least partially eliminating the soot or other impurities during flow of the soot or other impurities through the intermediate section, wherein said intermediate section and insert means provide essentially resistance free flow of the exhaust gas.

2. A device according to claim 1, wherein the metal grids include honeycomb grids with a predetermined axial minimum length.

3. A device according to claim 2, wherein the metal grids project from the exhaust gas inlet and the exhaust gas outlet by a predetermined axial minimum length into the respective exhaust pipe outer section.

4. Device according to claim 1, wherein the exhaust gas inlet and the exhaust gas outlet are arranged at opposite end front wall and have a nominal width essentially the same as a width of each respective exhaust pipe outer section, and wherein the intermediate section includes a circumferential wall between the end walls having a circular cross-section with a larger nominal width than the respective exhaust pipe outer sections.

5. A device according to claim 1, wherein the resonator is developed and excited as an $E_{01n}$-resonator, n being 0, 1, 2 . . . , and wherein the insert includes an a pipe with a nominal width corresponding to a width of each respective exhaust pipe outer section and which extends from the inlet to the outlet in axial alignment with the exhaust pipe outer sections.

6. A device according to claim 1, wherein the resonator is developed and excited as an $H_{01m}$-resonator, m being 1, 2, 3 . . . , and wherein the insert is a cylinder having reduced cross-section and that is closed at its respective ends and that, for producing a flow channel with a ring cross-section, is inserted centrally and axially into the resonator.

7. A device according to claim 6, wherein the insert tapers conically at its ends.

8. A device according to claim 6, wherein a second dielectric insert as a pipe having a nominal width that is enlarged with respect to the diameter of the first insert and of the exhaust pipe outer section is arranged concentrically with respect to the first insert in the resonator, and forms the outside wall for the exhaust gas flow channel.

9. A device according to claim 1, wherein several resonators each having at least one dielectric insert are inserted in series in the exhaust pipe.

10. A device according to claim 9, wherein adjacent resonators are arranged bordering on one another and each have a joint front wall having an exhaust gas opening carrying the metal grid.

11. A device according to claim 10, wherein the several resonators for the microwave coupling have a feeding coupling means and in the joint front walls each have a coupling element.

12. A device according to claim 1, wherein several resonators in parallel to one another are inserted into the exhaust pipe.

13. A device according to claim 1, wherein the resonator is thermally decoupled from the exhaust pipe.

14. A device according to claim 1, wherein a coupling line leading to the microwave source is thermally decoupled from the microwave source.

15. A device according to claim 1, wherein the resonator is cooled by a cooling system.

16. A device according to claim 15, wherein the cooling system is connected with the coolant system of the internal-combustion engine.

17. A device according to claim 1, wherein the resonator is formed of a metallic material with a low coefficient of thermal expansion.

18. A device as in claim 1, wherein said intermediate section and insert means provide resistance free flow of the exhaust gas by providing for flow therethrough devoid of a filter or trap.

* * * * *